United States Patent [19]

Usui

[11] 4,190,504

[45] Feb. 26, 1980

[54] ANTICORROSIVE OVERLAP-COATED STEEL MATERIAL

[75] Inventor: Masayoshi Usui, Numazu, Japan

[73] Assignee: Usui Kokusai Sangyo Kabushiki Kaisha, Shizuoka, Japan

[21] Appl. No.: 949,132

[22] Filed: Oct. 6, 1978

[30] Foreign Application Priority Data

Nov. 11, 1977 [JP] Japan ..... 52/135304
Nov. 11, 1977 [JP] Japan ..... 52/135305

[51] Int. Cl.[2] ..... C25D 5/10; C25D 5/48; C25D 5/26

[52] U.S. Cl. ..... 204/35 R; 204/40; 428/632; 428/648; 428/659; 428/935

[58] Field of Search ..... 204/40, 41, 56 R, 35 R; 428/935, 659, 629, 632, 648

[56] References Cited

U.S. PATENT DOCUMENTS 3,857,684 12/1974 Kubu ..... 428/935
3,986,843 10/1976 Adaniya ..... 204/35 R
4,048,381 9/1977 Adaniya ..... 204/35 R
4,064,320 12/1977 Adaniya ..... 204/40

*Primary Examiner*—T. M. Tufariello
*Attorney, Agent, or Firm*—Anthony J. Casella

[57] ABSTRACT

An anticorrosive overlapped coating so far practiced as applied to such iron and steel materials as plates, pipes, bars or wires is formed by electroplating an iron or steel material on the surface with an Sn base - Zn alloy layer and applying a chromate-treatment on it. However, this requires such long time in forming a plated layer thickness that a reduction of the plating time together with a further improvement of the anticorrosion is hoped for today. The present invention has succeeded in making it possible to reduce the plating time while improving the anticorrosion and in improving the productivity by forming an electroplated layer of an Sn base - Zn alloy directly or through an electroplated layer of Zn on the surface of a steel material, then forming an electroplated layer of Zn on the electroplated layer of said alloy and further applying a chromate-treatment on said Zn layer.

2 Claims, No Drawings

ANTICORROSIVE OVERLAP-COATED STEEL MATERIAL

BACKGROUND OF THE INVENTION

1. Field of the Invention

The present invention relates to improvements in the anticorrosion of an iron or steel material coated with an electroplated layer of an Sn base-Zn alloy.

2. Description of the Prior Art

Such anticorrosive coatings applied to such iron and steel materials as plates, pipes, bars or wires as meet respective requirements have been studied and developed. A steel material in which an electroplated layer of an Sn base-Zn alloy containing more than 50% by weight tin (this electro-plated layer shall be merely called on alloy or alloy layer hereinafter) is formed on the surface and a chromate-treatment is applied on said alloy layer is recently practiced. However, such alloy layer requires a long time in forming the required layer thickness or, for example, 20 to 25 minutes in forming a layer thickness of 15 to 20 microns making it unavoidable to reduce the productivity. Thus an improvement of the productivity together with a further improvement of the anticorrosion is hoped for today.

SUMMARY OF THE INVENTION

The present invention has reduced the forming time of such electroplated layer and has further improved the anticorrosion.

DETAILED DESCRIPTION OF THE INVENTION

Its subject matter is an anticorrosive overlap-coated steel material made by forming an electroplated layer of an Sn base-Zn alloy directly or through an electroplated layer of zinc on the skin surface of an iron or steel material, then forming an electroplated layer of zinc on said alloy layer and further applying a chromate-treatment on said zinc layer. If the above mentioned conventional overlap-coated steel material is shown by (c) as in the following, the overlap-coated steel materials according to the present invention will be shown as in (a) and (b):

(a) S-alloy-Zn-Cr.

(b)S-Zn-alloy-Zn-Cr.

(c) S-alloy-Cr.

In these indications, S is a steel, the alloy is an electroplated layer of an Sn base-Zn alloy of more than 50% by weight Sn, Zn is an electroplated layer of metallic zinc and Cr is a chromate layer. The conventional product of (c) shows that an electroplated layer of an alloy is applied to a steel skin and a chromate layer is formed on the alloy layer. The product of the present invention of (a) shows that an electroplated layer of an alloy is applied to a steel skin the same as in (c) but an electroplated layer of zinc is applied on the alloy layer and a chromate layer is applied on the zinc layer. The product of the present invention of (b) shows that an electroplated layer of zinc is applied to a steel skin, an electroplated layer of an alloy is applied on said zinc layer and a zinc layer is again electroplated on said alloy layer and a chromate layer is applied on said zinc layer.

The respective coating structures of these overlap-coated steel materials (a), (b) and (c) are shown in turn as follows:

(a') Alloy-Zn-Cr.

(b') Zn-alloy-Zn-Cr.

(c') Alloy-Cr.

The effects obtained by the present invention shall be described in the following.

First of all, from the fact that, if the chromate layer is removed from each of the coating structures (a') and (b') of the products of the present invention and the coating structure (c') of the conventional product, the coating structures (a') and (b') will be able to be considered to have been obtained by replacing a part of the alloy layer of the coating structure (c') with a zinc layer and the electroplated layer of zinc can be electroplated more easily and quickly than the electroplated layer of the alloy, it is understood that the electroplating time of the overlap-coated steel materials (a) and (b) according to the present invention is reduced to be shorter than of the conventional product (c). It is understood that the anticorrosion is remarkably improved because, in the case of the conventional product (c), a chromate-treatment is applied on an alloy layer containing more than 50% by weight tin and therefore the formation of chromate is insufficient, whereas, in the case of the products (a) and (b) of the present invention, a chromate-treatment is applied on a zinc layer and therefore the formation of chromate is sufficient. The differences between the anticorrosions obtained by both of these chromate treatments are shown in the test results of Example 1 and Control 1 mentioned in Table 1 mentioned later. Table 2 shows the differences of the respective samples tested in both examples. Example 1 is of a product (a) of the present invention and Control 1 is of an overlap-coated steel material (d) having the below mentioned coating structure (d'):

(d) Steel-Zn-alloy-chromate.

(d') Zn-alloy-chromate.

If the results mentioned in Table 1 are compared with the coating structures (a') and (d') mentioned in Table 2, as both coating structures (a') and (d') are made by overlapping alloy layers of the same thickness and zinc layers of the same thickness, the cause of the difference of the test results will be naturally understood.

The overlap-coated steel material (b) having the above mentioned coating structure (b') shall be described in the following. This coating structure (b') corresponds to a coating structure obtained by forming an electroplated layer of zinc on a steel skin surface and providing a coating structure (a') of the coated steel material (a) on said zinc layer. The anticorrosion obtained by this coating structure (b') is not expected to have any particular effect from the coating structures (a') and (d') mentioned in Table 2 and the test results mentioned in Table 1 but is far higher than of the coated steel material (a) of the coating structure (a'). This anticorrosion is shown by the comparison of the test results of Examples 2 and 3 mentioned in Table 3. The sample No. 3 obtained in this Example 3 and the sample No. 1 obtained in the above mentioned Example 1 are of the same coating structure (a') but the test results of Example 3 are adopted for the comparison with the test results of Example 2 because, as the total layer thickness of the sample No. 3 is equal to that of the sample No. 2 as mentioned in Table 4 and the total zinc layer thickness of both are equal to each other, they are judged to be adapted to the comparison of the effects.

EXAMPLE 1

Preparation of Samples 5 steel pipe materials of a material of ASTM A53-65, outside diameter of 18.0 mm, thickness of 1.2 mm and length of 500 mm were cleaned in an ordinary manner, as Sn base-Zn alloy was formed by electroplating in the below mentioned manner on the steel skin surface obtained by the cleaning, then a Zn layer was formed by electroplating on said layer, further a chromate-treatment was applied to this Zn layer surface to form overlap-coated steel pipes (a) provided with the above mentioned coating structure (a'). Each pipe was cut off at both ends to obtain 5 pipes of a length of 300 mm as sample No. 1.

Manner of forming the lower layer (75% by weight Sn-25% by weight Zn alloy)

A plating solution of a pH of 7 consisting of a composition of 22 g/l of tin sulfate, 14 g/l of zinc sulfate, 40 g/l of triethanolamine and 100 g/l of sodium gluconate was used, the above mentioned cleaned steel pipe materials were made cathodes, a 75% by weight Sn-25% by weight Zn alloy was made an anode, the solution temperature was kept at 30° C. and an electric current was passed at a cathode current density of 3 A/dm$^2$ for 17 minutes to form a plated layer of a thickness of 13 microns consisting of an Sn base-Zn alloy of the above mentioned composition on the steel skin surface. The steel pipe materials were fed to the next zinc layer forming step.

Manner of overlapping and forming the upper layer (zinc)

A plating solution of a pH of 3 consisting of a composition of 256 g/l of zinc sulfate, 11.2 g/l of aluminum chloride and 75 g/l of sodium sulfate was used, the five steel pipe materials obtained by being electroplated with the Sn base-Zn alloy in the preceding step were made cathodes, a zinc plate was made an anode, the solution temperature was kept at 50° C. and an electric current was passed at a cathode current density of 50 A/dm$^2$ to form a zinc layer of a thickness of 4 microns and purity of 100% by weight on the above mentioned alloy layer. The steel pipe materials were fed to the next chromate steps.

Chromate-treating manner

The overlap-plated steel pipes each obtained by overlapping the zinc layer on the alloy layer in the above mentioned respective plating steps were dipped at the normal temperature in a chromate bath (of DIPSOL Z-493 produced by DIPSOL Co., U.S.A.) for 20 seconds, were then taken out, were washed with hot water and were dried to obtain 5 expected sample No. 1. The samples were subjected to the next tests.

Salt Water Spray Test

They were tested by the provision of ASTM B-117 and were recorded in the following manner. In the table, R represents a red rust speck, RR represents a fluid red rust and the numerals attach to these products R and RR represent average values of the numbers generated at the time of recording. When RR was generated, only the RR was recorded irrespective of the generation of R.

Test Results

The sample No. 1 obtained in this example were tested with salt water sprays together with sample No. 4 obtained in the below mentioned Control 1 to obtain the results mentioned in the below mentioned Table 1.

By the way, if the test results in Table 1 are seen with reference to the description in Table 2 in which the coating formations of the respective samples are compared, the improvement of the anticorrosion of the products of the present invention obtained by changing the position of the zinc layer will be remarkable.

Three of the five samples of each of No. 1 and No. 4 were indiscriminately taken and tested.

Table 1

| | Test Results | | | | |
|---|---|---|---|---|---|
| Hour / Sample | 2000 | 2500 | 3000 | 3500 | 4000 |
| No. 1 (a) | | | | 1R | 1RR |
| No. 4 (d) | | 1R | 1RR | | |

Notes: No. 1 is a sample of the coated steel material (a) obtained in Example 1.
No. 4 is a sample of the coated steel material (d) obtained in Control 1.

Table 2

| | Coating Structures | |
|---|---|---|
| Sample / Coating | Example 1 No. 1 (a') | Control 1 No. 4 (d') |
| Upper layer treatment | Chromate | Chromate |
| Upper layer | Zn 4 microns | Alloy 13 microns |
| Lower layer | Alloy 13 microns | Zn 4 microns |
| Total layer thickness | 17 microns | 17 microns |

Note:
The chromate layer was so thin that its thicknesswas not mentioned.

The alloy in the table was an alloy of 75% by weight Sn and 25% by weight Zn.

Control 1

In Example 1, a zinc layer was formed on the steel skin surface by reversing the upper and lower plated layers, an Sn base-Zn alloy layer of the same composition was formed by electroplating on said layer and a chromate-treatment was applied on said alloy layer but otherwise exactly the same treatments were applied to obtain 5 overlap-plated steel pipes (d) provided with the above mentioned coating structure (d'). These were made sample No. 4 and were subjected to the next test.

Salt Water Spray Test

The same as in Example 1.

Test Results

The same as are mentioned in Table 1.

Control 2

In Example 1, the electroplating time of the alloy was made 22 minutes, no zinc electroplating was applied and a chromate-treatment was applied on the obtained alloy layer of a thickness of 17 microns but otherwise the same treatments were applied to obtain the same overlap-coated steel materials (c) as the conventional product having the above mentioned coating structure (c'). They were made sample No. 5 and were subjected to the next test.

Salt Water Spray Test

The same as in Example 1.

Test Results

The same as the test results in Control 1.

EXAMPLE 2

Preparation of Samples

Five of the same steel pipe materials as were used in preparing the samples in Example 1 were cleaned in the same manner, a lower layer of zinc, intermediate layer of an alloy and upper layer of zinc were formed in turn by electroplating in the below mentioned manners on the obtained steel skin surface and a chromate-treatment was applied on this upper layer surface to obtain overlap-coated steel pipes (b) provided with the above mentioned coating structure (b'). The respective pipes were cut off at both ends to obtain 5 pipes of a length of 300 mm. They were made sample No. 2.

Manner of forming the lower layer (zinc)

In the manner of forming the zinc layer in Example 1, the cleaned steel pipe materials were made cathodes and the current passing time was made one minute but otherwise the same treatments were applied to form a zinc layer of a thickness of 7 microns on the steel skin surface. The samples were then fed to the next step of forming an alloy layer.

Manner of forming the intermediate layer (75% by weight Sn-25% by weight Zn alloy)

In the manner of forming the alloy layer in Example 1, the steel pipe materials on each of which the zinc layer was formed in the preceding step were made cathodes and the current passing time was made 8 minutes but otherwise the same treatments were applied to obtain an alloy layer of a thickness of 6 microns consisting of the above mentioned composition on the zinc layer. Then the samples were fed to the next plating step.

Manner of forming the upper layer (zinc)

In the manner of forming the above mentioned zinc layer, the plates steel pipes obtained in the preceding step and having the alloy layer formed on the zinc layer were made cathode and the current passing time was made 35 seconds but otherwise the same treatments were applied to obtain plated steel pipes having a zinc layer of a thickness of 4 microns in the upper layer. They were then fed to the next step.

Chromate-treating manner

In the chromate-treating manner in Example 1, the coated steel materials of the steel-Zn-alloy-Zn obtained through the above mentioned respective steps were dipped in a bath but otherwise the same treatments were applied to obtain 5 expected overlap-coated steel pipes (b). They were fed as sample No. 2 to the next test.

Salt Water Spray Test

The same as the test in Example 1.

Test Results

The sample No. 2 obtained in this Example together with the sample No. 3 obtained in Example 3 were subjected to the salt water test to obtain the results in the below mentioned Table 3.

By the way, if the test results in Tables 1 and 3 are seen by comparing the coating structures of the respective samples as mentioned in the above mentioned Table 2 and below mentioned Table 4, it will be recognized that the anticorrosion is most improved by providing the coating structure (a') through the zinc layer on the steel skin.

By the way, three of five of each of the sample Nos. 2 and 3 were indiscriminately taken and tested.

Table 3

| | Test Results | | | | |
|---|---|---|---|---|---|
| Hour / Sample | 2000 | 2500 | 3000 | 3500 | 4000 |
| No. 2 (b) | | | | | 1R |
| No. 3 (a) | | | 1R | 1RR | |

Notes: No. 2 is a sample of the coated steel material (b) obtained in Example 2. No. 3 is a sample of the coated steel material (a) obtained in the later mentioned Example 3.

Table 4

| | Coating Structure | |
|---|---|---|
| Coating | Sample Example 2 No. 2 (b') | Example 3 No. 3 (a') |
| Upper layer treatment | Chromate | Chromate |
| Upper layer | Zn 4 microns | Zn 11 microns |
| Intermediate layer | Alloy 6 microns | |
| Lower layer | Zn 7 microns | Alloy 6 microns |
| Total layer thickness | 17 microns | 17 microns |

Notes: 1) The alloy mentioned in the table is an alloy of 75% by weight Sn and 25% by weight Zn.
2) The sample No. 3 is of the same coating structure (a') as of the above mentioned Example 1.

EXAMPLE 3

Preparation of Samples

In Example 1, the lower layer and upper layer were formed in the below mentioned manners but otherwise the same treatments were applied to obtain 5 coated steel materials (a) of a length of 300 mm provided with the above mentioned coating structure (a') as sample No. 3.

Manner of forming the lower layer (75% by weight Sn-25% by weight Zn alloy)

In the manner of forming the alloy layer in Example 1, the steel pipe materials having cleaned steel skins were made cathodes and the current was passed for 8 minutes but otherwise the same treatments were applied to form a plated layer of a thickness of 6 microns consisting of the above mentioned alloy on the steel skin surface. The samples were fed to the next step.

Manner of forming the upper layer (zinc)

In the manner of forming the zinc layer in Example 1, the steel pipe materials obtained by forming the alloy layer on the steel skin in the preceding step were made cathodes and the current passing time was made 95 seconds but otherwise the same treatments were applied to obtain plated steel pipes having a zinc layer of a thickness of 11 microns on the alloy layer. They were fed to the next step.

Chromate-treating manner

In the chromate-treating manner in Example 1, the steel pipe materials obtained by overlap-coating in the order of the steel-alloy-Zn in the above mentioned respective manners were dipped in a chromate bath but otherwise the same treatments were applied to obtain sample No. 3. They were fed to the next test.

Salt Water Spray Test

The same as the test in Example 1.

Test Results

The same as are mentioned in Table 3.

Tables 5 and 6 are provided in the following and the anticorrosions of the respective samples obtained in the respective examples and the time required for plating are collectively mentioned in them so as to be convenient to compare.

Table 5

| Sample | Collective Test Results Hour 2000 | 2500 | 3000 | 3500 | 4000 |
|---|---|---|---|---|---|
| No. 1 (a) | | | | 1R | 1RR |
| No. 2 (b) | | | | | 1R |
| No. 3 (a) | | | 1R | 1RR | |
| No. 4 (d) | | 1R | 1RR | | |

Notes: 1) The total coating thickness was 17 microns in each.

2) The test results of the conventional products (c) were the same as of No. 4 (d).

3) The sample Nos. 1, 2 and 3 were obtained in the respective examples but No. 4 was obtained in Control 1.

Table 6

| Sample | Comparison of Plating Time: Total coating thickness | Plating time |
|---|---|---|
| Example 1 No. 1 (a') | 17 microns | 17 minutes 50 seconds |
| Example 2 No. 2 (b') | 17 microns | 9 minutes 35 seconds |
| Control 5 No. 5 (c') | 17 microns | 22 minutes 20 seconds |

Notes: 1) For the plating time of each layer, see the description of each example.
2) The sample Nos. 1 and 2 are products of the present invention. No. 5 is a conventional product.

I claim:

1. An anti-corrosive overlap-coated steel material made by forming an electroplated layer of an Sn base-Zn alloy directly on the skin surface of an iron or steel material, then forming an electroplated layer of zinc on said alloy layer and further applying a chromate-treatment on said zinc layer.

2. An anti-corrosive overlap-coated steel material made by forming an electroplated layer of an Sn base-Zn alloy through an electroplated layer of zinc on the skin surface of an iron or steel material, then forming an electroplated layer of zinc on said alloy layer and further applying a chromate-treatment on said zinc layer.

* * * * *